United States Patent [19]

Lyngstrup

[11] Patent Number: 4,501,203

[45] Date of Patent: Feb. 26, 1985

[54] SAFETY MECHANISM FOR PREVENTING THE LOCKING UP OF PERSONS IN CABINETS

[75] Inventor: Arne Lyngstrup, Herlev, Denmark

[73] Assignee: A/S Sparevirke, Copenhagen, Denmark

[21] Appl. No.: 468,057

[22] PCT Filed: Jun. 29, 1982

[86] PCT No.: PCT/DK82/00059

§ 371 Date: Feb. 17, 1983

§ 102(e) Date: Feb. 17, 1983

[87] PCT Pub. No.: WO83/00180

PCT Pub. Date: Jan. 20, 1983

[30] Foreign Application Priority Data

Jun. 30, 1981 [DK] Denmark ..... 2908/81

[51] Int. Cl.[3] ..... E05G 1/04

[52] U.S. Cl. ..... 109/635; 292/144; 292/DIG. 65

[58] Field of Search ..... 109/63, 63.5, 60, 69, 109/59 R; 292/144, 150, DIG. 65

[56] References Cited

U.S. PATENT DOCUMENTS

| | | | |
|---|---|---|---|
| 2,765,648 | 10/1956 | Hatcher | 292/144 |
| 2,783,722 | 3/1957 | Fletcher | 109/63.5 |
| 2,851,970 | 9/1958 | Ferdon | 109/63.5 |
| 3,068,811 | 12/1962 | Jenne et al. | 109/63.5 |
| 3,256,841 | 6/1966 | Klingaman | 109/63.5 |
| 3,563,586 | 2/1971 | Creamer et al. | 292/144 |
| 4,053,939 | 10/1977 | Nakauchi et al. | 292/144 |

FOREIGN PATENT DOCUMENTS

| | | | |
|---|---|---|---|
| 2386669 | 12/1978 | France | 292/144 |

*Primary Examiner*—Gene Mancene
*Assistant Examiner*—Kris R. Schulze
*Attorney, Agent, or Firm*—Schwartz, Jeffery, Schwaab, Mack, Blumenthal & Koch

[57] ABSTRACT

In a safety mechanism intended for preventing the locking up of persons in bank strong rooms is incorporated a main latch bolt which is movable between an inoperative position and a protruding position in which it abuts against the strong room door and the associated frame and thereby prevents the closing of the door; in its protruding position the main latch bolt is arrested by an auxiliary latch bolt which, like the main latch bolt, is spring-loaded towards the protruding position; each of the latch bolts is associated with an electromagnet which electromagnets cause, when energized, the retraction of the latch bolts to their inoperative position and are incorporated in a common electric circuit comprising an automatic switch in the strong room floor; normally this switch is closed, but is automatically opened when a person steps on the floor of the strong room, preventing thereby the energization of the two electromagnets and consequently the retraction of the latch bolts.

1 Claim, 1 Drawing Figure

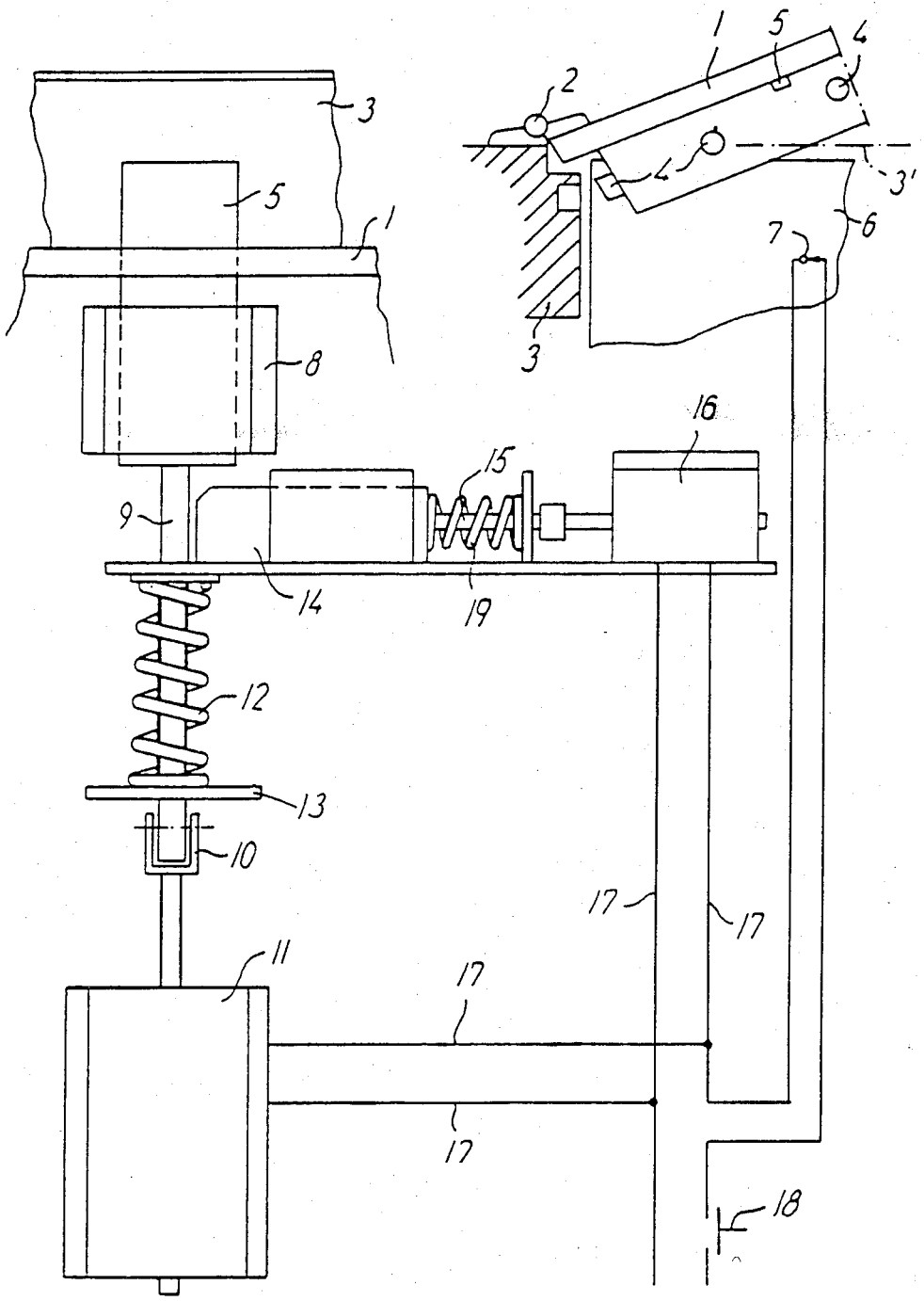
1
5
4
2
3
5
1
3'
7
6
3
8
16
15
9
14
19
12
13
10
17
17
11
17
17
18

SAFETY MECHANISM FOR PREVENTING THE LOCKING UP OF PERSONS IN CABINETS

It sometimes happens during a bank robbery that staff and possibly customers are locked up in the strong-room of the bank. In view of this situation, it is known to provide strong-room doors with an internal emergency handle which allows an opening of the door from the inside. Such emergency handles, however, cause always a weakening of the locking mechanism of the door, so that it no longer meets the standard requirements as to safety. Furthermore, the provision of an internal emergency handle is rather expensive, especially when an already existing strong-room door is concerned. To this must be added that there are many types of strong-room doors which require various types of emergency handles.

In banks, an ordinary safety measure consists in leaving the latch bolts in their protruding positions after the opening of the strong-room in the morning, so that the door cannot be closed again during the day without using a key. This increases the safety against the locking up of persons in the room between the opening and closing time, but the risk is still present precisely at these moments, because the key must then be near the room. Furthermore, one cannot expect this safety measure to be always observed.

The invention has for its object to provide a safety mechanism which to the largest extent prevents the risk of locking up of persons, which is comparatively cheap with regard to manufacture and installation, and which can be used in a standard design in connection with strong-room doors of any type, the mechanism being either built in when the door is manufactured or mounted later on.

Thus, the invention relates to a safety mechanism for preventing the locking up of persons in cabinets, in particular strong-rooms of banks, by means of a latch bolt independent of the normal locking system of the cabinet and serving to prevent an unauthorized closing of the door of the cabinet, said latch bolt being carried by the cabinet door or the associated door frame and being spring-loaded from an inoperative, retracted position towards a protruding position in which, by abutment against the frame or the door, respectively, it prevents a complete closing of the door.

A safety mechanism of this type, for a partly different purpose, though, is known from U.S. Pat. No. 2,783,722. This patent discloses a refrigerating box, an ice-box or the like having a normally closed door operable only from the outside and provided with a firm bottom in which a displaceable plunger or latch bolt is built in, said plunger being spring-loaded to abut against the inner side of the door when closed. When the door is opened, the latch bolt follows outwards to the above-mentioned protruding position and normally it is pressed back against the action of the spring, when the door is completely closed. Above the firm bottom is disposed a movable bottom which is maintained in a raised position by one or more springs which, however, are not strong enough to carry the weight of a person, e.g. a child who has climbed into the box while playing, and this movable bottom is provided at its underside with a lug which, when the bottom is pressed down, engages with a groove in the protruding latch bolt and thereby arrests it against backward movement, so that the door cannot close completely.

A safety mechanism according to this known principle must be regarded as quite inadequate, when the problem is to prevent the locking up of persons meant as a criminal act, e.g. in the strong-room of a bank. For instance, it will be extremely easy to block the movable bottom in its inoperative, raised position, and the latch bolt may also easily be arrested in its retracted position, which will be sufficient to make the protection quite illusory.

The safety mechanism according to the invention differs from the known device by the provision of an auxiliary latch bolt associated with the above-mentioned latch bolt, which auxiliary latch bolt is also spring-loaded from an inoperative, retracted position towards a protruding position in which it arrests the first-mentioned bolt, or main bolt, in its protruding position and by the provision of a couple of electromagnets, one for each of the latch bolts, which electromagnets are arranged so as to retract, when energized, the latch bolts against the action of the springs and are incorporated in a common circuit provided with a switch which is normally closed but is automatically opened when a person enters the room, and with an additional, independently operable switch. The first one of these switches may suitably be built into the floor of the cabinet and be arranged so that it is closed when the floor is unloaded but opens when somebody steps on the floor.

Assuming that the circuit is de-energized when the cabinet door is opened, the main latch bolt will, under the action of the spring, jump forward into its blocking position as soon as it is disengaged from the edge of the frame or the door, respectively, and by this movement of the main latch bolt, the auxiliary latch bolt will be automatically released so that it is also brought into its protruding position under the action of its spring, in which position it arrests the main latch bolt and thereby prevents its retraction against the action of the spring. In this situation, it will consequently not be possible to close, even less to lock the cabinet door.

As long as the cabinet floor is unloaded, it will be possible to energize the two electromagnets by closing the independently operable switch which may be located anywhere, e.g. remotely from the cabinet, and it will be possible to close and lock the door in an ordinary manner only when both latch bolts have thus been retracted to their inoperative positions. The current can afterwards be switched off again by opening of the additional switch, so that the bolts are again ready to operate when the door is opened anew. A condition for energizing the two electromagnets is, however, that both the additional switch and the switch serving as person detector or load detector in the cabinet are closed, which will only be the case when nobody is present in the cabinet. With his normal facilities and tools, a bank robber will consequently not be in a position to close the door of a cabinet in which one or more persons are present, regardless of the fact that he may be in possession of the keys for operating the normal cabinet lock.

A special advantage is that the said circuit is de-energized when the two latch bolts are in their protruding positions, so that it will not be possible to sabotage the system by cutting one or more electric wires.

An embodiment of a safety mechanism according to the invention will now be more fully explained with reference to the rather schematic drawing.

In said drawing, 1 indicates a cabinet door which by means of a hinge 2 is hung on a frame 3 and which comprises ordinary latch bolts 4. At its upper edge the door comprises, furthermore, an additional bolt 5 which is the previously mentioned main latch bolt and which in its protruding position, see the left top corner of the figure, will in case of an attempt at closing the door 1 abut against the front edge 3' of the frame 3, so that a complete closing of the door will be excluded.

The cabinet floor is indicated by 6 and is provided with a switch 7 which remains closed as long as the floor 6 is unloaded, but opens automatically when the floor is loaded, e.g. in case a person enters the cabinet.

In the embodiment shown, the main latch bolt 5 of the safety mechanism is slidable in a guide 8 on the door 1 and through a spindle 9 and a yoke 10 it is connected with the armature of an electromagnet 11. Through a disc 13 fixed on the spindle 9, a compression spring 12 loads constantly the latch bolt 5 in the direction of its protruding position, as shown.

A second latch bolt 14, the so-called auxiliary bolt, with spindle 15, electromagnet 16 and compression spring 19 is disposed transversely to the main bolt 5 and in such a position that the auxiliary bolt in its protruding position, as shown, engages beneath the main bolt 5 and thereby prevents a retraction of said bolt to its inoperative position.

The two electromagnets 11 and 16 are incorporated in a common electric circuit 17, one conductor of which includes the automatic switch 7 placed in the cabinet, and an external, manual switch 18.

Assuming that the cabinet floor 6 is unloaded, so that the switch 7 is closed, a closing of the manual switch 18 will actuate the two electromagnets 11 and 16 to retract the bolts 5 and 14 to their inoperative positions. A delay relay, not shown, can ensure that the main bolt 5 does not collide with the auxiliary bolt 14 during the retraction movements. Thereafter, the cabinet door can be closed and by opening the manual switch 18, the spring 12 will push the main bolt forward to abut against the underside of the frame 3, while the spring 19 in a corresponding manner will push the auxiliary bolt 14 forward to abut against the side of the main bolt. Another opening of the cabinet door 1 will therefore automatically result in the two bolts 5 and 14 jumping forward into the positions shown in the drawing.

It is clear that the explained retraction of the two latch bolts presupposes that not only the manual switch 18 but also the floor switch 7 in the cabinet are closed and, consequently, the retraction cannot take place if the cabinet floor 6 is loaded by one or more persons.

I claim:

1. A strong room structure including a frame member providing an entrance opening, a door member mounted in said frame member, and a mechanism for preventing unauthorized closing of said door when at least one person is present on the floor of said room, said mechanism comprising a primary bolt carried by one of said frame and door members and displaceable between a retracted inoperative position and a protruded operative position whereby in said operative position said primary bolt prevents closing of said door by abutment against the other one of said frame and door members, first spring means normally urging said primary bolt toward said operative position, a first electromagnet having sufficient strength when energized to retain said primary bolt in said inoperative position against the action of said first spring means, an auxiliary bolt carried by said one of said frame and door members and displaceable between a retracted inoperative position and a protruded operative position for preventing retraction of said primary bolt from the operative position of said primary bolt, second spring means normally urging said auxiliary bolt towards its operative position, a second electromagnet having sufficient strength when energized to retain said auxiliary bolt in said inoperative position against the action of said second spring means, an electric circuit for actuating said first and second electromagnets and including a normally closed first switch adapted to be automatically opened by the weight of a person entering said room and a second independently operable switch for actuating said first and second electromagnets.

* * * * *